United States Patent [19]

Anderson

[11] Patent Number: 4,979,524

[45] Date of Patent: Dec. 25, 1990

[54] HAIR TREATMET DISPENSING APPARATUS

[76] Inventor: Antonio Anderson, 2308 Candler Rd., Decatur, Ga. 30034

[21] Appl. No.: 305,537

[22] Filed: Feb. 2, 1989

[51] Int. Cl.[5] ..... A45D 19/16

[52] U.S. Cl. ..... 132/272; 132/202; 132/207; 4/516

[58] Field of Search ..... 132/112, 202, 203, 204, 132/205, 206, 207, 208, 209, 212, 271, 272; 4/515, 516, 517, 518, 519, 523; 222/109, 135; 417/477

[56] References Cited

U.S. PATENT DOCUMENTS

| | | | |
|---|---|---|---|
| 2,049,035 | 7/1936 | Wilsey | 132/206 |
| 2,133,638 | 10/1938 | Sugerman | 132/272 |
| 2,895,486 | 7/1959 | Sayer | 132/212 |
| 2,922,425 | 1/1960 | Lerner et al. | 132/212 |
| 3,044,473 | 7/1962 | Cover | 132/212 |
| 3,190,502 | 6/1965 | Knibb | 4/517 |
| 3,429,642 | 2/1969 | Underwood | 132/116 |
| 3,450,140 | 6/1969 | Vail | 132/212 |
| 3,575,181 | 4/1971 | Rudd | 4/516 |
| 3,882,864 | 5/1975 | Montgomery | 4/517 |
| 4,074,369 | 2/1978 | Harmon | 4/518 |
| 4,081,867 | 4/1978 | Simeola | 4/516 |
| 4,377,174 | 3/1983 | Muraji et al. | 132/206 |
| 4,674,902 | 6/1987 | Turner | 132/112 |
| 4,834,120 | 5/1989 | Rumez | 132/202 |
| 4,834,121 | 5/1989 | Bell | 4/516 |
| 4,860,391 | 8/1989 | Hildebrandt | 4/516 |

FOREIGN PATENT DOCUMENTS

| | | | |
|---|---|---|---|
| 0402898 | 12/1933 | United Kingdom | 4/516 |

*Primary Examiner*—John J. Wilson
*Assistant Examiner*—Frank A. LaViola, Jr.
*Attorney, Agent, or Firm*—Rodgers & Rodgers

[57] ABSTRACT

Hair treatment dispensing apparatus comprising a housing, a pump, a reservoir containing a hair treatment solution, a nozzle for dispensing the solution, the reservoir, nozzle and a pump being interconnected by flexible tubing, and the solution being adapted to flow toward and away from the nozzle.

8 Claims, 3 Drawing Sheets

HAIR TREATMET DISPENSING APPARATUS

BACKGROUND OF THE INVENTION

This invention relates to an apparatus which is especially adapted for the dispensing of various solutions generally in the professional treatment of human hair. Such solutions include relaxers, straighteners, coloring agents, neutralizers and permanent wave solutions. Usually these chemical agents are applied to a customer's hair by manually dipping a comb or other applicator into the chemical solution and then manually applying the solution as required. Naturally this process is unreliable and wasteful. In addition, the cosmetologist's skin is caused to come into prolonged contact with these chemicals.

Besides manual application techniques, hair treatment machines are known and are exemplified by U.S. Pat. Nos. 2,171,725; 3,357,599 and 3,429,642. These treatment machines are complicated and not well adapted for the efficient and economical dispensing of hair treatment chemicals.

On the other hand, this invention allows for the dispensing of a wide variety of chemicals conveniently and economically and is adaptable for the dispensing of a varying number of chemicals as desired. In addition, waste is greatly reduced since the chemicals are always retained in the original container when not being dispensed.

SUMMARY OF THE INVENTION

By this invention, hair treatment dispensing apparatus is provided and comprises a housing, pump means, a reservoir containing a hair treatment solution, a nozzle for dispensing solution, the reservoir and nozzle being interconnected by flexible tubing, the pump means being disposed operably intermediate the reservoir and the nozzle, and the pump means being adapted to apply a positive and a negative pressure on the tubing.

DESCRIPTION OF THE PREFERRED EMBODIMENT

Figure 1:
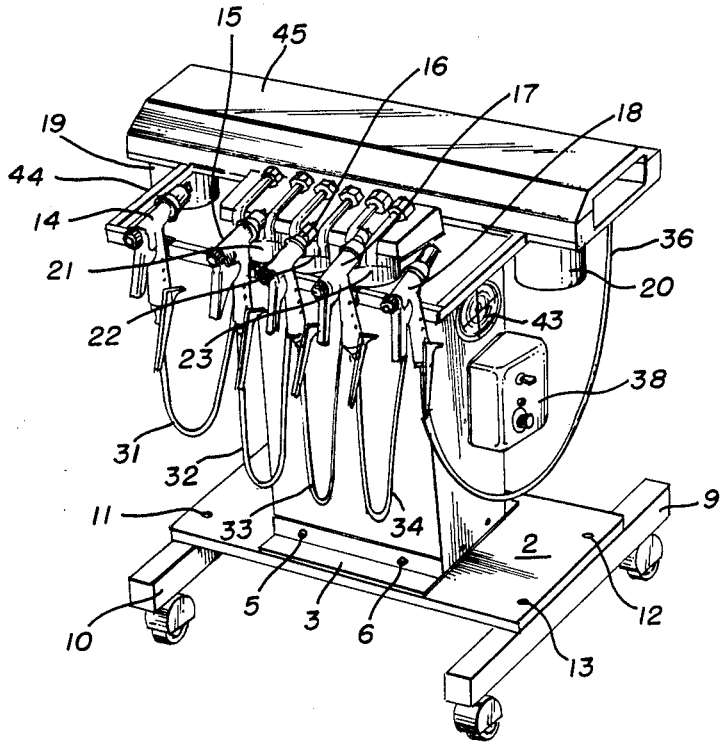
FIG. 1 is a perspective view of the hair treatment dispensing apparatus according to this invention.
Figure 2:
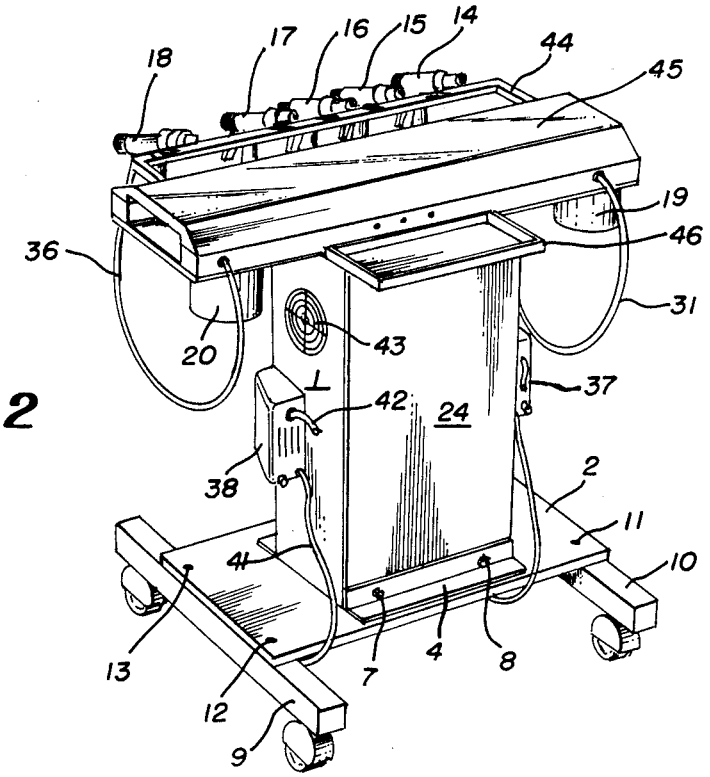
FIG. 2 is a rear perspective view of the apparatus.

In the drawings, the numeral 1 identifies the apparatus housing according to this invention. Housing 1 is secured to plate 2 by means of brackets 3 and 4. Bracket 3 is attached to housing 1 by means of screws 5 and 6 and, likewise, bracket 4 is attached to housing 1 by means of screws 7 and 8. Brackets 3 and 4 are secured to plate 2 by any suitable means such as welding and the like.

In order to provide means for conveniently transporting the apparatus to various work stations, the entire apparatus is mounted on roller means 9 and 10 and secured thereto by means of attachment screws 11, 12 and 13. The second attachment screw in connection with roller means 10 is not observable in the drawings. Also crossbar 1*a* extends across the top of housing 1 and is secured thereto by welding or the like.

For the purpose of applying the various chemicals to a customer's hair, a plurality of nozzles 14, 15, 16, 17 and 18 are provided. Containers for the various chemicals are provided in the form of reservoirs 19, 20, 21, 22 and 23. Reservoirs 19 and 20 are generally used for thick solutions such as relaxers, cold wave straighteners and bleaches. Reservoirs 21, 22 and 23 are used for generally thin solutions in the form of water, neutralizers, boosters, permanent wave solutions, hair color solutions and the like.

Figure 3:
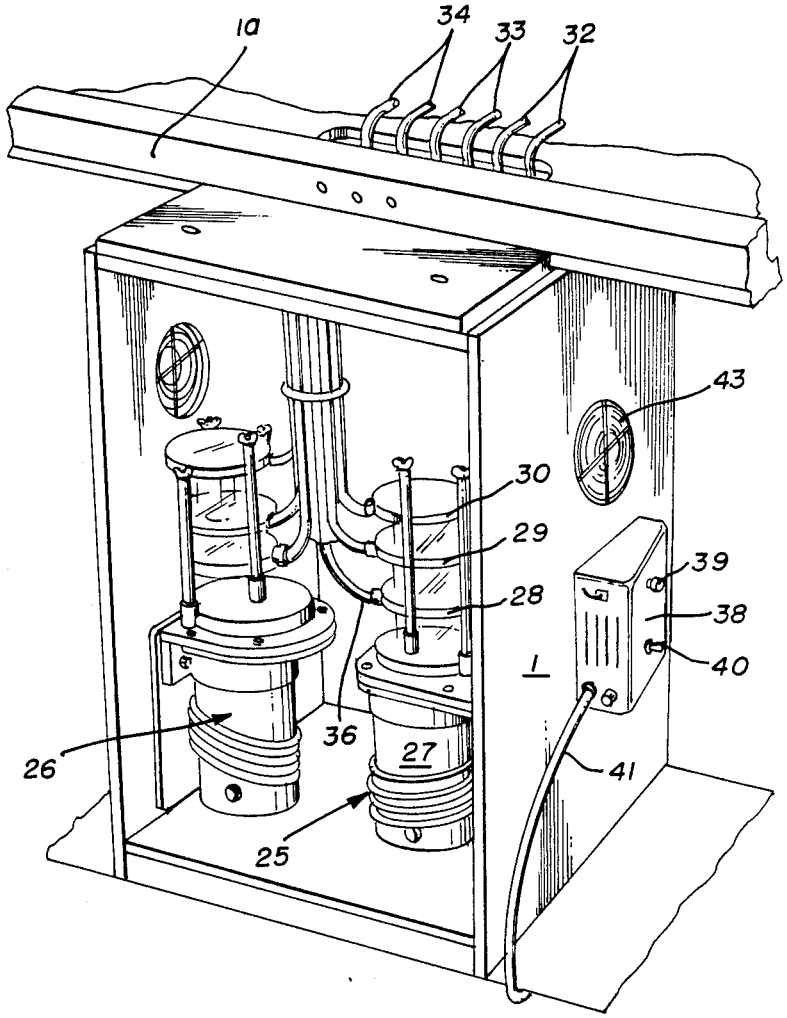
FIG. 3 is an enlarged perspective view with the rear housing cover removed.
Figure 4:
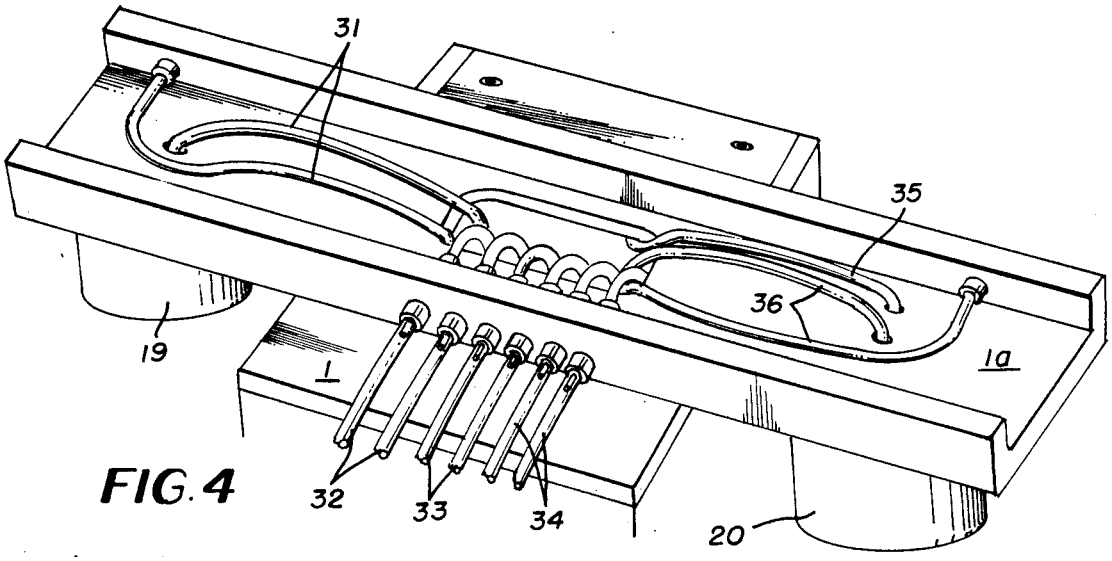
FIG. 4 is an enlarged perspective view showing the upper portion of the apparatus.

Mounted interiorly of housing 1 and as best shown in FIG. 3 with housing back plate 24 removed, pump means is provided in the form of a pair of pumps indicated generally by the numerals 25 and 26. Each pump means is identical and, therefore, only one will be discussed in detail. More specifically, pump means 25 is provided with motor 27 and is operably interconnected with multiple pump heads 28, 29 and 30.

Figure 5:
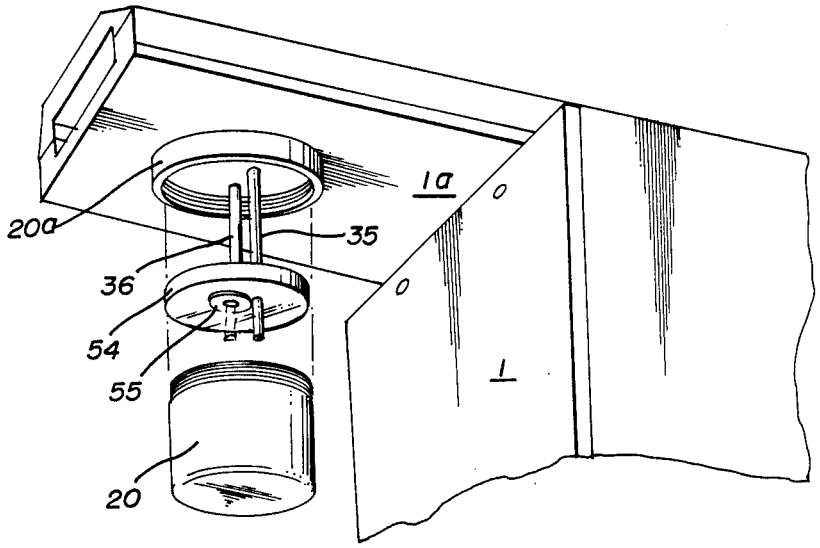
FIG. 5 is an enlarged perspective view showing a chemical reservoir.
Figure 6:
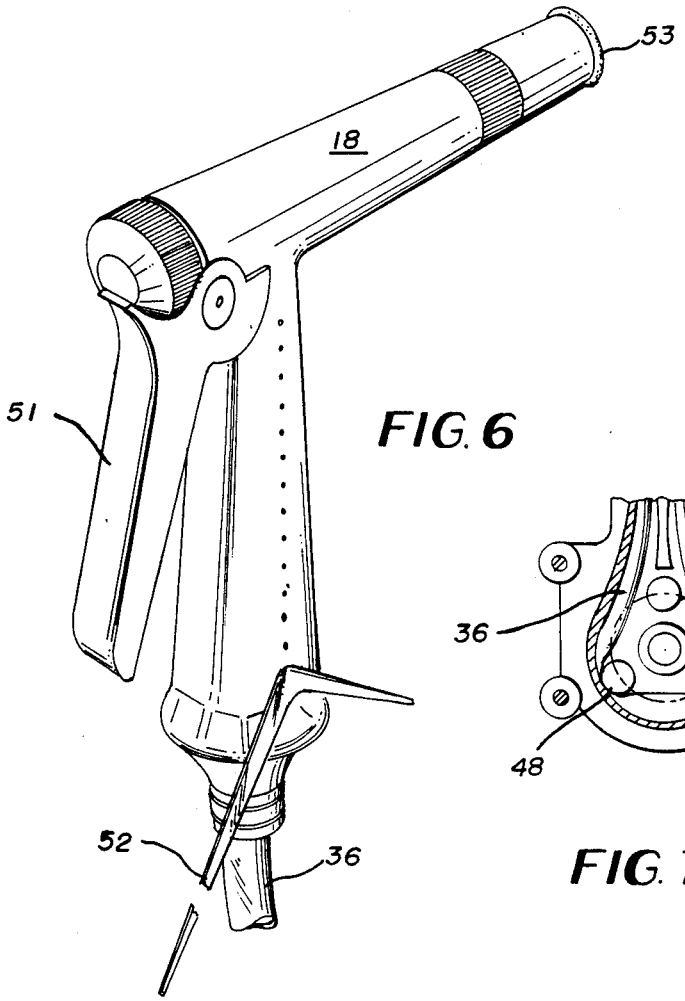
FIG. 6 is an enlarged perspective view of the nozzle.

Interconnecting one reservoir and one associated nozzle is a single portion of flexible tubing. In the present invention, there are six tube elements identified by the numerals 31, 32, 33, 34, 35 and 36. Disposed operably intermediate each nozzle and each reservoir is the associated pump head from either pump means 25 or 26. Generally a single continuous piece of flexible tubing and a single pump head are required in association with each nozzle and each associated reservoir. In order to increase the pumping capacity for use in connection with specially thick solutions, it is simply necessary to add one or more pump head and associated tubing in addition to the existing normal single pump head and single tubing element. In FIG. 5, a second flexible tubing element shown in connection with reservoir 20. This additional tubing is operable in connection with a separate pump head to provide twice the pumping action which is especially necessary in connection with thick solutions. Of course, only a single tube and associated structure is necessary in connection with thinner solutions. When a double pumping configuration is utilized, the two tubes are spliced together between the pumping and nozzle functions.

Control means for pump means 26 and 25 is provided, respectively, in the form of controls 37 and 38. Since each control means is identical, only one will be discussed in detail. More specifically, control 38 is provided with forward and reverse toggle switch 39 and speed control knob 40. Control 38 is appropriately interconnected with an electric power source by means of conductor 41 and is operably interconnected with pump means 25 by means of conductor 42. In order to provide for proper ventilation of pump means 25 and 26, vent 43 is formed in housing 1.

For the purpose of storing nozzles 14–18 when not in use, attachment bar 44 is secured to housing 1 and is provided with multiple Velcro strips which are attachable to corresponding Velcro strips on nozzles 14–18.

In order to cover portions of the flexible tubing and other internal elements of the apparatus, top plate 45 is provided and is secured to crossbar 1*a*. Also to provide space for the storage of necessary combs, brushes and other items, accessory tray 46 is appropriately secured to housing 1 on the opposite side of the apparatus from attachment bar 44.

For the purpose of illustration, the operation of only one nozzle and associated structure will be discussed in detail, it being understood that the other nozzles and associated structure are the same in operation. First of all, reservoir 20 is withdrawn from an existing inventory of hair treatment products and then the top is removed and discarded. Reservoir 20 then is screwed into the apparatus top 20*a* as best shown in FIG. 5. Top 20*a* is adhered to the underside of crossbar 1*a*. At this point, one end of flexible tubing 36 is disposed in the solution of reservoir 20. Tubing 36 extends upwardly therefrom from reservoir 20 and into housing 1 and ultimately through pump head 28 and then back upwardly through the interior of housing 1 through the side of crossbar 1*a* and ultimately to nozzle 18.

Figure 7:
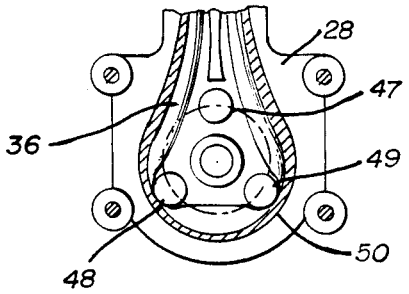
FIG. 7 is a schematic representation of the apparatus pump means.

When it is desired to apply the chemical solution of reservoir 20 to a customer's hair, control 38 is plugged into a wall receptacle and toggle switch 39 is placed in a position to direct the flow of the treatment solution toward nozzle 18. This action causes motor 26 to turn rollers 47, 48, and 49. As shown in FIG. 7, rollers 48 and 49, in effect, pinch tubing 36 against wall 50 of pump-head 28 thereby trapping air and any solution contained within tubing 36 therebetween. As rollers 48 and 49 rotate in a counterclockwise direction, fluid and/or air is trapped between rollers 48 and 49 thereby causing a flow of solution toward nozzle 18. Of course, the flow is maintained by the successive operation of roller 47 in combination with roller 48 and so forth. The continual rotation of rollers 47, 48 and 49 builds appropriate pressure in nozzle 18 which allows an even stream of solution to be dispensed through the outlet port by simply manually squeezing handle 51 or nozzle 18.

Also nozzle 18 is provided with an elongated hair manipulation piece 52 which is secured to handle 51 by any known means.

In order to enhance the flow of solution from nozzle 18, an absorbent applicator tip 53 is secured to the outlet port of nozzle 18 by means of friction or otherwise. Applicator tip 53 is formed of sponge rubber or any other similar absorbent material. Of course, applicator tip 53 can also be formed of various shapes and sizes to provide the appropriate orifice for dispensing the desired solution.

During the dispensing operation, air pockets sometimes form in connection with especially thick solutions, and therefore, compression disc 54 is provided. Flexible tubing 36 and any additional tubes extend through compression disc 54 and then compression disc 54 is caused to overlie the contents of reservoir 20. Since the diameter of compression disc 54 and the inner diameter of reservoir 20 are essentially the same, withdrawal of the contents of reservoir 20 causes a vacuum and compression disc 54 is lowered and continuously kept in contact with the contents of reservoir 20. This effectively prevents any air pockets from forming in reservoir 20 or in the flexible tubing. In order to provide additional compression, one or more weights 55 can be adhered to compression disc 54 as necessary.

Following the application of the various solutions to the customer's hair, the nozzle, tubing and pump are generally full of the associated solution. In order to withdraw the solution back into the reservoir, it is simply necessary to move toggle switch 39 in the opposite direction to reverse motor 27 and cause rollers 47, 48 and 49 to turn in a clockwise direction thereby applying pressure to tubing 36 to cause the solution to flow back into reservoir 20. This process causes the pressure between the reservoir and the pump means to be lessened thereby directing the flow of solution from the nozzle through the flexible tubing and pump means into the reservoir.

In essence, when it is desired to dispense a flow of solution through a particular nozzle, the pump means causes the pressure on the tubing to be less than ambient pressure between the reservoir and pump means and a pressure greater than ambient pressure between the pump means and the nozzle. In similar fashion, when it is desired to direct the flow of solution into the associated reservoir, the pump means causes the pressure on the tubing to be less than ambient pressure between the nozzle and the pump means and a pressure greater than ambient pressure between the pump means and the reservoir.

Therefore, by this apparatus, multiple solutions of varying viscosity are conveniently, safely and economically dispensed especially in a professional beauty salon or barber shop setting.

I claim:

1. Hair treatment dispensing apparatus comprising a housing, a pump associated with said housing, a reservoir containing a hair treatment solution, a nozzle for dispensing said solution, said reservoir and said nozzle being interconnected by means of deformable flexible tubing, said pump being disposed operably intermediate said reservoir and said nozzle, said pump having means for applying a pressure less than ambient pressure on said tubing between said reservoir and said pump and a pressure greater than ambient pressure on said tubing between said nozzle and said pump to dispense a flow of said solution from said reservoir through said nozzle, and said pump further having means for applying a pressure less than ambient pressure on said tubing between said nozzle and said pump and a pressure greater than ambient pressure on said tubing between said reservoir and said pump to direct the flow of said solution from said nozzle into said reservoir.

2. Apparatus according to claim 1, wherein an absorbent applicator tip is detachably connected to said nozzle.

3. Apparatus according to claim 1 wherein said nozzle comprises a handle and an elongated hair manipulation piece is secured to said handle.

4. Apparatus according to claim 1 wherein said housing has an upper portion and wherein an accessory tray is secured to said upper portion.

5. Apparatus according to claim 1 wherein a compression disc is positioned inside said reservoir.

6. Apparatus according to claim 5 wherein said compression disc has a diameter, said reservoir has an inner diameter, and said diameter is substantially the same as said inner diameter.

7. Apparatus according to claim 5 wherein a weight is secured to said compression disc.

8. Apparatus according to claim 1 where said housing is mounted on roller means.

* * * * *